US005639131A

United States Patent [19]

Fuehrer

[11] Patent Number: 5,639,131

[45] Date of Patent: Jun. 17, 1997

[54] TAMPER RESISTANT SEAL WITH CONTROLLED BREAK

[75] Inventor: Charles Fuehrer, Scarsdale, N.Y.

[73] Assignee: Stoffel Seals Corporation, Tuckahoe, N.Y.

[21] Appl. No.: 502,696

[22] Filed: Jul. 14, 1995

Related U.S. Application Data

[63] Continuation-in-part of Ser. No. 375,693, Jan. 20, 1995, abandoned.

[51] Int. Cl.[6] ..... B65D 27/30

[52] U.S. Cl. ..... 292/310; 292/307 R; 292/320

[58] Field of Search ..... 292/307 R, 312, 292/313, 320, 321, 307 A

[56] References Cited

U.S. PATENT DOCUMENTS

| | | | |
|---|---|---|---|
| 979,452 | 12/1910 | Edgar, Sr. . | |
| 1,001,209 | 8/1911 | Miller . | |
| 1,064,462 | 6/1913 | Edgar . | |
| 1,100,372 | 6/1914 | Houck . | |
| 1,155,772 | 10/1915 | Tyden . | |
| 1,344,491 | 6/1920 | Edgar . | |
| 1,369,010 | 2/1921 | Dinsmoor . | |
| 1,416,683 | 5/1922 | Brooks . | |
| 1,762,961 | 6/1930 | Dessauer . | |
| 1,821,418 | 9/1931 | Brooks . | |
| 1,934,121 | 11/1933 | Fluker . | |
| 1,937,743 | 12/1933 | Brooks . | |
| 2,130,787 | 9/1938 | Borland . | |
| 2,312,023 | 2/1943 | Brooks | 40/20 |
| 2,465,349 | 3/1949 | Brooks . | |
| 2,794,278 | 6/1957 | Percival et al. . | |
| 2,809,651 | 10/1957 | Moberg . | |
| 2,914,354 | 11/1959 | Moberg | 292/307 R |
| 2,926,944 | 3/1960 | Moberg . | |
| 2,965,401 | 12/1960 | Nierhaus . | |
| 2,980,462 | 4/1961 | Moberg . | |

OTHER PUBLICATIONS

P. 5, Stoffel Self–Lock® Seal and Stoffel Fold–Lok®, from Stoffel Tamper Resistant Seals, 1983 Stoffel Seals Corporation.

*Primary Examiner*—Rodney M. Lindsey
*Assistant Examiner*—Monica E. Millner
*Attorney, Agent, or Firm*—Dowell & Dowell

[57] ABSTRACT

A tamper resistant seal and method of forming a seal including a strip having at least one end portion which is foldable about one or more score lines each having two or more segments which converge with one another across the strip generally obliquely relative to a longitudinal axis thereof and wherein the end portion is caused to be severed in a controlled manner to provide visual evidence of tampering.

19 Claims, 2 Drawing Sheets

Fig. 11
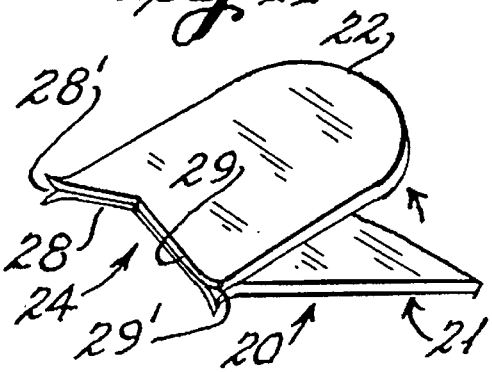
Fig. 12
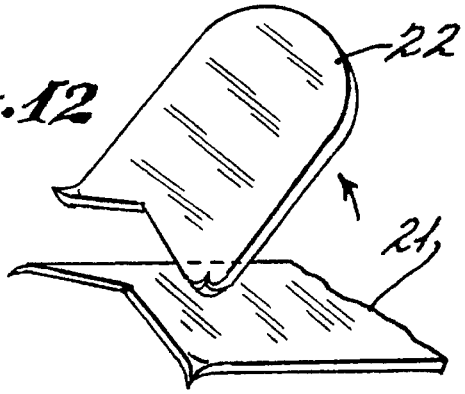
Fig. 13
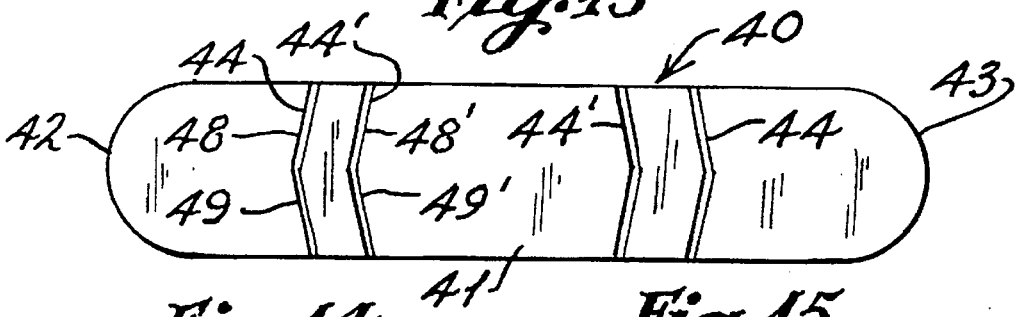
Fig. 14
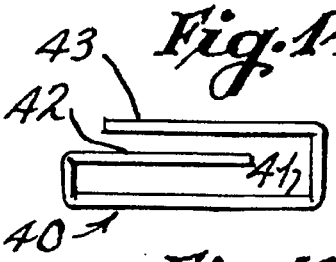
Fig. 15
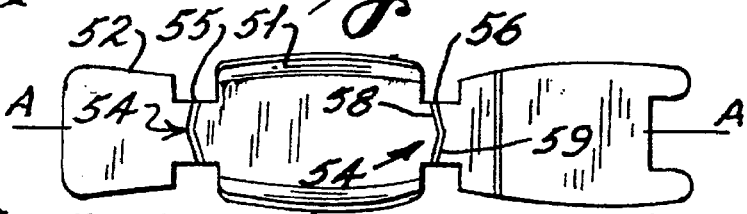
Fig. 16
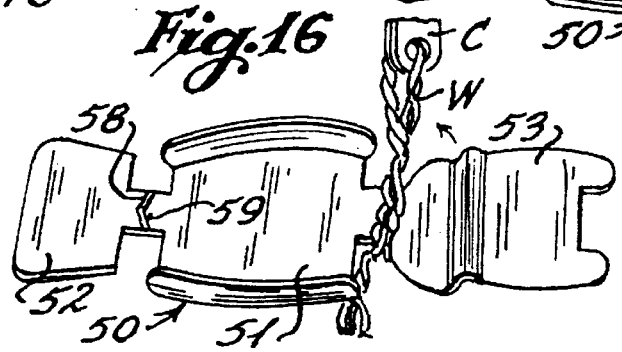
Fig. 17
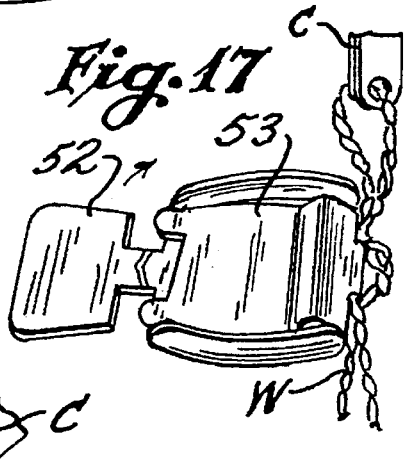
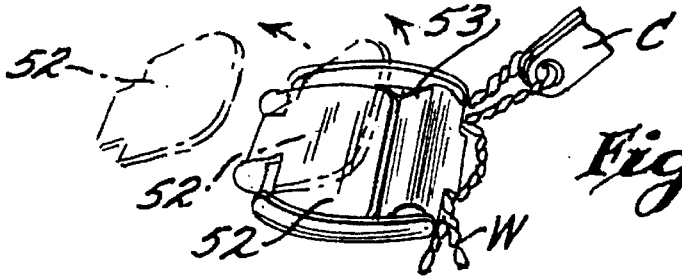
Fig. 18

TAMPER RESISTANT SEAL WITH CONTROLLED BREAK

CROSS-REFERENCE TO RELATED APPLICATIONS

This application is a Continuation-in-Part of U.S. patent application Ser. No. 08/375,693 now abandoned, filed Jan. 20,1995 to the present inventor entitled TAMPER RESISTANT SEAL AND METHOD OF FORMING THE SAME.

BACKGROUND OF THE INVENTION

1. Field of the Invention

This invention is directed to seals of the type which are designed and constructed so that a portion of the seal is severed if, after the seal has been in placed in use by folding a first portion of the seal relative to another portion thereof, any attempt is made to remove the seal by unfolding the first portion so that visual evidence is immediately provided of tampering. Such seals are utilized to provide an indication of unauthorized access to enclosures such as buildings, vehicles, bags or pouches, meters and other areas or items.

More particularly, the present invention is directed to such seals having one or more end portions which are connected to the main body of the seals by one or more lines of weakness or score lines which includes two converging segments which are oriented generally in an oblique angle with respect to longitudinal axis or centerlines of the seals and which segments extend across the width of such seals. The score lines are specifically designed to cause an initial weakening along the score line segments upon initially folding the end portions relative to the main body of the seals and wherein a controlled break or severing of the end portions along the segments results if any attempt is made to unfold the end portions after they have been folded. In this manner, the seals cannot be manipulated or tampered with to gain access to a sealed area without destroying the seals.

2. History of the Related Art

There are numerous metallic and plastic seals which have been designed to give a visual indication of tampering with the seals after they have been placed into use. Such seals are not designed to physically prevent individuals from gaining access to sealed areas or enclosures, but rather to deter tampering by producing evidence of tampering and thus increasing the risk that the tampering will be subsequently discovered. Such seals are widely utilized for use with electric, gas, and water meters, shipping containers including cargo containers, tanks, drums, bags, boxes, pouches, vehicles such as trucks and tractor trailers, storage warehouses and security areas.

Known seals, however, have not been satisfactory to provide clear and consistent evidence of tampering in all cases where tampering has actually occurred. Conventional seals have been constructed from metallic sheet materials and have included score lines which function to locally weaken the seals. Such seals have been designed to be able to withstand limited bending about the scores without severing, and to sever along the scores if bent again to re-open the seal. Generally, such seals have been designed to sever along the scores following bending in two different directions about the scores.

Such known seals are exemplified by U.S. Pat. Nos. 979,452 to Edgar, Sr., and 2,926,944 and 2,980,462 to Moberg. The known seals have included scores oriented either perpendicularly or at oblique angles relative to the longitudinal axis of the seals. However, with such seals, a bending force applied at an end portion of a seal will not necessarily act directly along the scores to cause severing to occur. That is, with conventional seals, whether the bending force acts along the scores is dependent on how and where the force is applied at the end portions of the seals when bending the seals. Bending forces applied to the end portions during tampering will not always act on the scores such that a seal will inevitably be severed to indicate tampering. Thus, the known seals are inadequate.

By way of example, many conventional seals are designed so that an end portion of the seals is foldable about a score line into a substantially overlapping relationship with a main body of the seals to thereby retain a wire, strap, cable, handle or other locking or closure element therebetween. The seals are supposed to sever in the event an end portion is unfolded away from the captured wire or other element and thus provide the necessary indication of tampering. However, due to the difficulty in controlling the depth of the scores and the variations in the materials which are utilized to form conventional seals, it is sometimes possible to manipulate an end portion of the seals a sufficient degree to allow the seal to be tampered with without severing the end portion. If the end portion does not sever, the seals have not provided the necessary function of providing evidence of tampering.

Additional prior art bend-break seals are disclosed in U.S. Pat. Nos. 1,001,209 to Miller, 1,064,462 to Edgar, 1,100,372 to Houck, 1,155,772 to Tyden, 1,344,491 to Edgar, 1,416,683 to Brooks, 1,762,961 to Dessauer, 1,934,121 to Fluker, 1,937,743 to Brooks and 2,130,787 to Borland.

SUMMARY OF THE INVENTION

The present invention has been made in view of the above inadequacies of the prior art and has a primary objective to provide tamper resistant seals having portions which are severed along predetermined controlled break lines so that the bendable portion of the seal will be severed after a predetermined bending motion has been achieved relative to the remaining portion of the seal.

It is a further object of the present invention to provide tamper resistant seals which have one or more severable portions which are foldable along one or more score lines each of which has intersecting or converging segments wherein the severable portions cannot be manipulated without being physically detached from the remaining portion of the seals along the score lines.

It is also an object of the present invention to provide a method for forming metallic tamper resistant seals wherein the score lines associated with such seals are formed in at least two converging segments so as to ensure a controlled break of the seals after a predetermined bending motion of the severable portions of the seals, regardless of variations in material thickness or temper.

It is yet a further object of the present invention to provide a method for forming one or more score lines in seals of a type designed to have severable portions wherein the method includes forming each score line with at least two segments which extend at an oblique angle relation to an elongated axis of the seals and wherein the scores are formed to a depth to cause an initial severing along the outer portions or the inner portions, as desired, of the score segments by an initial bending movement of a severable portion relative to the main body of the seal so that a controlled break is immediately established when the seal is placed into use.

The tamper resistant seals of the present invention include a body or strip portion which includes at least one end which is bendable about one or more score lines which separate the end portion from the remaining body of the seal. Each score line consists of at least two segments which converge with one another or at an opening therebetween either at an elongated centerline or central axis of the seals or spaced on one side thereof and which segments are oriented generally at an oblique angle with respect to the axis.

The score line segments are either straight or arcuate and are formed to a depth so that portions of each segment will sever upon an initial bending movement of a severable end portion toward an overlying relationship with respect to the main body of a seal. The score lines are also formed so as to ensure that any reverse bending of the severable portion of the seal results in a complete severance of such portion within a predetermined angular displacement relative to the main body of the seal.

BRIEF DESCRIPTION OF THE DRAWINGS

In the accompanying drawings:

FIG. 11 is a perspective illustrational view of the embodiment of the invention shown in FIG. 9 wherein a partial severing of the outer portion of each segment of the score line is achieved upon the initial bending movement of the end portion of the seal relative to the body of the seal, as indicated by the arrow in the drawing figure;

FIG. 12 is a perspective illustrational view of the seal of FIG. 11 showing a complete severing of the end portion upon a reverse bending movement illustrated by the arrow in the drawing figure;

FIG. 13 is a top plan view of another embodiment of the present invention showing two pairs of score lines formed in the body of the seal;

FIG. 14 is a side elevational view of the seal of FIG. 13 folded into a use position in which the end portions are overlapping one another;

FIG. 15 is a top plan view of a conventional foldable seal incorporating the converging segmented score lines of the present invention; and FIGS. 16 through 18 are illustrational views of the seal of FIG. 15 showing the end portions of the seal being folded over into a first use position in FIG. 17 and showing one end portion of the seal being severed upon a reverse bending movement as indicated by the arrow in FIG. 18.

DETAILED DESCRIPTION OF THE PREFERRED EMBODIMENT

Figure 1:
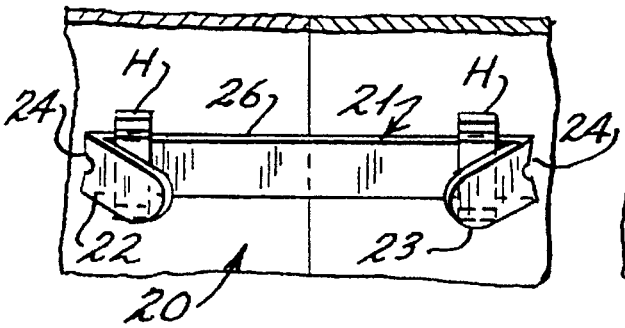
FIG. 1 is a perspective illustrational view of one embodiment of tamper resistant seal formed in accordance with the teachings of the present invention illustrating the seal in use sealing the doors of a vehicle.

With continued reference to the drawings, FIG. 1 illustrates a tamper resistant seal 20 in accordance with the present invention in use sealing the pivotable doors of a trailer or truck (not shown). The seal includes a body portion 21 and opposite severable end portions 22 and 23. As exemplified in FIGS. 3–8, the seal includes a pair of score lines 24 which are stamped, formed, or cut into the upper surface 25 of the seal in such a manner as to ensure the end portions are severed upon a predetermined folding or bending movement relative to the main body of the seal. The seal body has opposite side edges 25 and 26.

Figure 2:
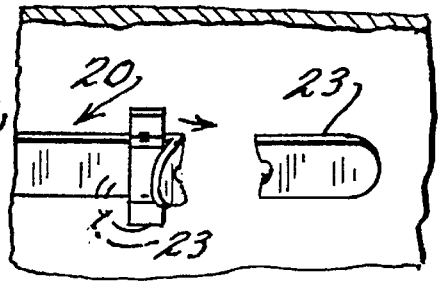
FIG. 2 is a partial perspective illustrational view of the embodiment of FIG. 1 showing an end portion of the seal being severed by bending the end portion in the direction of the arrow in the drawing figure.

As shown in FIG. 1, the seal is positioned through openings (not shown) defined by handles H mounted to the rear doors of the vehicle or trailer. In order to provide a clear indication of tampering, the end portions 22 and 23 are folded over the handles H into generally overlying relationship with respect to the body portion 21 of the seal. In this position, the doors cannot be opened without damaging the seal. Further, in order to obtain access to the sealed area, it is necessary to bend the ends outwardly, as shown in FIG. 2, so that the seal may be removed from between the handles H. the score lines of the present invention are designed to ensure that the end portions sever, as shown in FIG. 2, at a predetermined angle of less than 90° , and preferably less than 60° , which will give a positive indication that tampering has occurred.

As previously discussed, in conventional seals of this general type, it is sometimes possible to defeat the tamper indicating function of the seal by carefully manipulating the end portions to extend them outwardly after they have been bent into a use position similar to that shown in FIG. 1. By slightly bending the main body of the seal and without fully extending the end portions, it is possible, with conventional seals, to slide one of the end portions free of one of the handles to permit access to the enclosure. The present invention utilizes specifically structured score lines to ensure that the end portions are severed before they can be extended, as shown in FIG. 2, after being initially folded to the position of FIG. 1.

Figure 3:
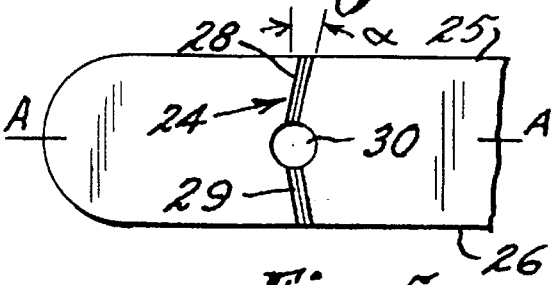
FIG. 3 is a partial top plan view of a seal similar to that shown in FIG. 1 showing a first form of score line having converging segments which are spaced by an opening through the seal.
Figure 4:
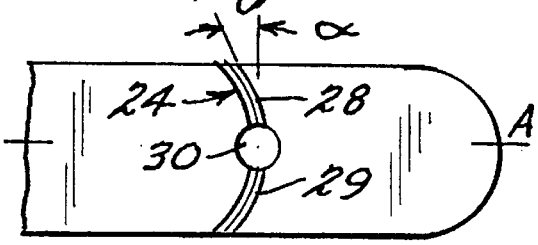
FIG. 4 is a partial top plan view of an embodiment of the invention similar to FIG. 1 showing a second configuration of arcuate score line having converging segments with an opening in the seal.
Figure 5:
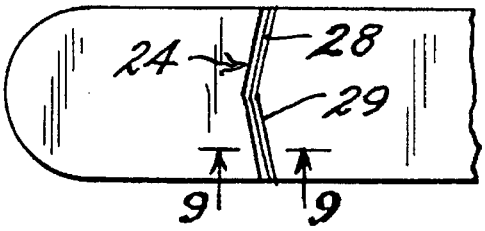
FIG. 5 is a partial top plan view of a seal similar to that shown in FIG. 3 without an opening in the body of the seal.
Figure 6:
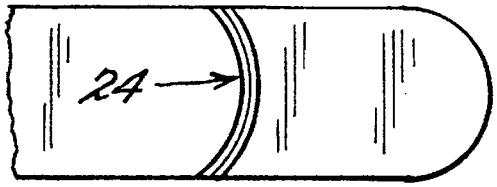
FIG. 6 is a partial top plan view similar to that of FIG. 4 showing the arcuate score line segments without an opening through the seal.
Figure 7:
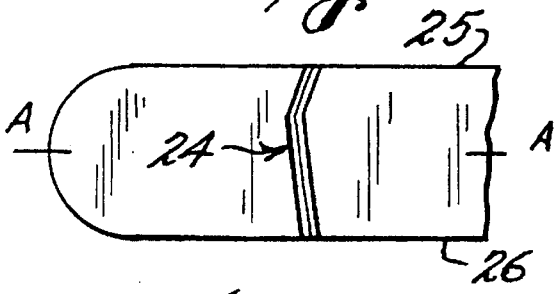
FIG. 7 is a partial top plan view showing another configuration for straight score line segments formed in accordance with the teachings of the present invention.
Figure 8:
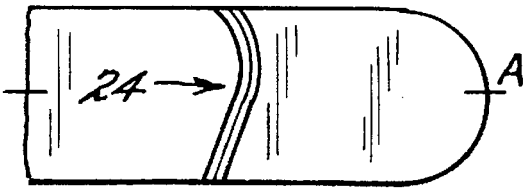
FIG. 8 is a partial top plan view of another embodiment of arcuate score line segments formed in accordance with the teachings of the present invention.

With continued reference to FIGS. 3–8, each score line 24 includes a pair of converging segments 28 and 29 which are formed in the upper surface of the seal and which extend at an oblique angle a with respect to the longitudinal centerline or primary axis A—A of the seal. As shown in FIG. 3, one or more openings 30 may be provided which communicate with the segments of each score line or, as shown in FIGS. 5–8, no openings may be provided. In FIGS. 3, 5 and 7, the segments 24 are formed as straight scores. In FIGS. 3 and 5, the segments are generally of equal length and intersect at the axis A—A of the seal. However, as shown in FIG. 7, the length of the segments may vary with respect to one another and the score lines may intersect on one or the other side of the elongated axis. Further, as shown in FIGS. 4, 6 and 8, the score line segments may be formed arcuately and may either be continuous or separated by one or more openings 30. Further, as shown in FIG. 8, the degree of arc of the segments may change from one side of the elongated axis to the other and still provide the controlled breakage which is necessary to provide an indication of tampering.

In accordance with the present invention, the depth of the scores may be varied depending on the composition and characteristics, such as the mechanical properties and thickness, of the material used to form the seal. For example, the depth of the scores will be greater for relatively ductile materials to assure that severing will occur along the scores. Preferably, and as shown in FIG. 11, the depth of the scores will be adequate to assure that the score segments will be severed adjacent the edges 25 and 26 of the seal, as shown at 28' and 29', when the end portions are initially bent in the direction indicated by the arrow wherein the end portions are moved into a generally overlying relationship with respect to the body portion 21 of the seal. This initial outer fracturing of the score segments will facilitate and assure the remaining portion of the segments will be completely severed when any attempt is made to bend the end portions toward their original position.

With specific reference to FIG. 12, the scores of the present invention are specifically formed to a predetermined depth to ensure that the segments will be completely severed with respect to the main body portion of the seal as they are reversely bent, as shown by the arrow in FIG. 12. Generally, severing will occur when the end portions have been bent at 60° or less with respect to the body portion of the seal so that it is not possible to manipulate the end portions to remove the seal to gain access to a sealed enclosure.

The score segments 28 and 29 are inclined, as previously stated, at an oblique angle a relative to the longitudinal axis A—A of the seal. The magnitude of this angle will also effect the point at which fracturing or severing along the score segments occurs during the relative bending motion of the end portions relative to the main body of the seal. Although each score segment is preferably oriented at substantially the same oblique angle $\alpha$ with respect to the longitudinal axis of the seal, it is possible, as shown in FIG. 8, to vary the angle between the two line segments and still obtain a controlled severing of the segments. Due to the oblique orientation of each of the score segments with respect to the axis of the seal, the bending of the end portions will cause a more uniformed tearing and fracturing along the score segments to consistently occur than is possible with conventional bend-break seals. In the present invention, the oblique angles are preferably 45° or less with angles of between 3° and 10° being preferred.

The oblique angles of the score segments 28 and 29 are preferably substantially equivalent so that a controlled and uniform fracture will consistently occur along both segments regardless of where the bending force is applied at the end portions of the seal. Furthermore, by forming the pairs of score segments at an oblique angle, the end portions will bend substantially perpendicular to the longitudinal axis of the seal regardless of the direction of force applied to create the bend. This is different than conventional structures. This equivalent inclination of the scores also assures that uniform and complete severing will consistency occur along the score segments when the end portions are reversely bent to a similar degree.

The tamper resistant seals in accordance with the present invention provide an advantage over conventional seals having continuous oblique or perpendicular scores extending between their opposite edges. Conventional seals have failed to assure uniform fracturing as they do not initiate longitudinal shearing along a score during bending and the forces applied along the scores are not always directed uniformly along the scores. That is, with conventional seals having a single diagonal score, the bending movement tends to be generally perpendicular with respect to the score. Therefore, if force is applied to bend the end portions of the seals perpendicularly to the body portion, it is possible that unequal force will be applied along the scores and a portion of the seals may be crimped in an area which is not scored. With diagonal scores, normally the end portions of the seals would have to be folded in a manner so that the fold is accomplished perpendicularly about the score so that the end portions of the seals are disposed at an angle with respect to the body portion of the seals. This, however, requires a concentrated application of force to bend the end portions in the appropriate plane which is not always possible when such seals are placed into use.

In addition to the foregoing, when prior art bend/break seals are reversely bent, there is no shearing action created along the line of the score and the material merely pivots about the score line. Because of this and because of the normal manufacturing variances, in some instances, the material may not fracture even though the score was provided to create a fracture after a given amount of bending movement. The failure to fracture can occur when a score is inappropriately applied to a seal such as when the depth of the score is insufficient to create a break upon the reverse bending of the seal. This is not the case with the present invention wherein the oppositely directed score segments direct the bending forces along the two converging segments. The material is sheared during bending of the end or severable portions thereby actually tearing the material at the same time that the material is being fractured. In this manner, with the present invention, an initiation of the shearing action begins upon the initial bending of the end portions into their use positions, as is shown in FIG. 11. By initiating the shearing as a seal is applied, a complete severance is assured after only limited reverse bending of the seal.

Therefore, the present invention offers a unique manner for controlling and assuring positive severing of the end portions of a seal by creating pairs of score segments which extend outwardly relative to the axis of the body portion of the seal at generally the same or slightly different oblique angles. With the present invention, even if bending force is applied with a vector which is not perpendicular to either of the score segments, the oppositely directed score segment will positively ensure that each point along each score segment is appropriately bent and will ensure, upon reverse bending, that each point along each score segment is sheared relative to an adjacent point to positively sever the end portions when any tampering movement is applied to the end portions of the seals. Therefore, tamper resistant seals in accordance with the present invention have a structure such that uniform fracture and subsequent severing will consistently occur along the score segments if any attempt is made to tamper with the end portions of the seal.

The seal is preferably formed of a metallic material such as aluminum or steel. The material preferably has adequate corrosion resistance for outdoor use or may be coated to provide such corrosion resistance. Non-metallic materials that will similarly sever during bending to provide an indication of tampering may optionally be used such as, for example, plastic materials. By way of further example, a seal such as shown in FIGS. 1 through 8 may be composed of aluminum material of approximately 10 inches in length having a width of approximately 0.5 inch and a thickness of approximately 0.020 inch. These dimensions may vary depending on the particular end use for the seal. The depth of the scores 24 may vary depending on the type of material and may range from approximately 0.005 to 0.010 inch. The depth of the scores may be varied depending on the mechanical properties and thickness of the material used to form the seal. The segments of the score lines are preferably formed so as to create a predetermined initial fracturing or severing along the outer portions of each segment as initial predetermined bending motion of the end portions has occurred, FIG. 11, and complete severing when only a limited degree of reverse bending has occurred, FIG. 12.

Figure 9:
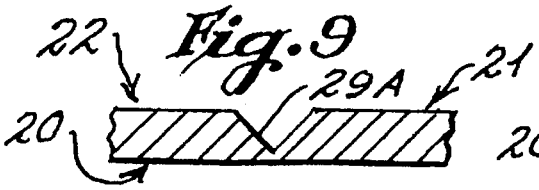
FIG. 9 is an enlarged partial section taken along line 9—9 of FIG. 5.
Figure 10:
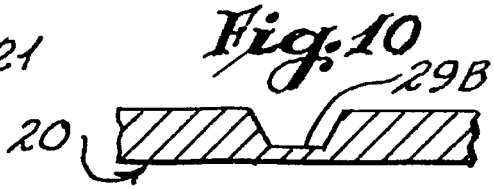
FIG. 10 is an enlarged partial section of another embodiment of score line formation which may be utilized in keeping with the teachings of the present invention.

With particular reference to FIGS. 9 and 10, the scores may be formed in a V-shaped configuration, as shown at 29A, or a generally trapezoidal U-shaped configuration, as shown at 29B, depending upon the type of seal and the intended use for the seal.

With specific reference to FIGS. 13 and 14, another embodiment of the present invention is shown in greater detail. In this embodiment, the seal 40 includes a body portion 41 and end portions 42 and 43. The end portions are spaced from the body portion by pairs of score lines 44 and 44' each of which is formed having converging score segments 48 and 48' and 49 and 49', respectively. In the embodiment shown, the scores are formed having a generally trapezoidal U-shape profile, as shown in FIG. 10, however, a V-shaped profile, as shown in FIG. 9, may also be utilized. The score segments are formed in the same manner to exhibit the same characteristics as discussed above with respect to the embodiment of FIGS. 1 through 12. In use, as the seal is folded so that the end portion 43 overlies end portion 42 and with both end portions overlying the main body of the seal, each of the outermost or edge portions of the segments 48 and 49 and 48' and 49' will have begun to shear. Any attempt to unfold any portion of the seal will result in the severance of at least one of the score lines 44 or 44' in a manner as previously discussed.

With respect to FIGS. 15 through 18, the teachings of the present invention are shown incorporated into a conventional seal 50. The seal is designed to prevent tampering with a wire W which extends through openings in a pair of closure members C. The seal includes a body portion 51 and foldable end portions 52 and 53 which are connected to the body portion through connecting segments 55 and 56, respectively. Scores 54 are provided across the full width of each connecting segment 55 and 56 in a manner as previously described with respect to the embodiment of FIGS. 1 through 8. In this manner, each score line 54 includes a pair of converging score segments 58 and 59 which are oriented at an oblique angle with respect to the longitudinal axis A—A of the seal.

In use, the wire "W" is initially twisted and then wrapped around the connecting segment 56, as is shown in FIG. 16. Thereafter, end portion 53 is folded into overlying relationship with the body portion 51 of the seal, as is shown in FIG. 17. During this movement, the outermost portions of each of the score segments 58 and 59 is severed in the manner as shown in FIG. 11. Any attempt to reversely bend end portion 53 to unwrap the wire W will result in the complete fracturing of score line 54 thereby severing the end portion 53. As a safety, end portion 52 is folded in overlying relationship with end portion 53, as is shown in full line in FIG. 18. During this initial bending, the score line 54 extending across the connecting segment 55 will also initially begin to shear along the outer edges of each segment 58 and 59. Again, any attempt to raise end portion 52 will result in the complete fracturing of the score line 54 along its full width, thereby, severing the end portion 52, as is shown in dotted line FIG. 18.

As is noted in FIG. 18, the angle at which severance of the end portions occurs can be controlled. In this embodiment, it is necessary to ensure that end portion 52 cannot be raised to a point where it is possible to manipulate end portion 53 and therefore, the break should occur at an angle of between 0° to 60° and preferably 45° or less.

The foregoing description of the preferred embodiments of the invention have been presented to illustrate the principals and not to limit the invention to the particular embodiments illustrated. It is intended that the scope of the invention be defined by all of the embodiments encompassed within the following claims and their equivalents.

I Claim:

1. A tamper indicating seal comprising: a body portion having a front surface and first and second side edges, at least one severable end portion extending from said body portion, said body portion having a longitudinal axis, a first score line in said front surface of said body portion, said score line separating said at least one severable end portion and said body portion, said first score line including first and second segments, said first segment extending from said first edge toward said longitudinal axis and said second segment extending from said second edge toward said longitudinal axis, said first and second seqments converging toward one another so as to meet with one another at a point spaced intermediate said side edges, and each of said first and second segments extending at an oblique angle relative to said longitudinal axis of said body portion whereby said at least one severable end portion will be severed from said body portion upon a predetermined pivotal movement of said at least one severable portion about said first and second segments of said first score line relative to said body portion.

2. The tamper indicating seal of claim 1, wherein said first and second segments extend at the same oblique angle relative to said longitudinal axis.

3. The tamper indicating seal of claim 2, wherein said oblique angle is not greater than 45° with respect to a line extending perpendicularly to the longitudinal axis.

4. The tamper indicating seal of claim 3, wherein said oblique angle is from about 3° to about 10°.

5. The tamper indicating seal of claim 3, in which each of said first and second segments extends in a straight line.

6. The tamper indicating seal of claim 5, in which said first and second segments converge at said point approximately at said longitudinal axis.

7. The tamper indicating seal of claim 3, in which each of said first and second segments is generally arcuate.

8. The tamper indicating seal of claim 7, in which said first and second segments converge at said point approximately at said longitudinal axis.

9. The tamper indicating seal of claim 1, including first and second severable end portions, first and second score lines extending between said first and second severable end portions and said body portion, respectively, and each of said first and second score lines including first and second segments extending at an oblique angle with respect to the longitudinal axis of said body portion.

10. The tamper indicating seal of claim 9, in which each of said first and second segments of said first and second score lines extend at substantially the same angle with respect to said longitudinal axis.

11. The tamper indicating seal of claim 10, in which said first and second segments of each of said first and second score lines extend at an oblique angle of not greater than 45° with respect to a line extending perpendicularly with respect to said longitudinal axis of said body portion.

12. The tamper indicating seal of claim 11, in which said first and second segments of said first and second score lines converge at said point adjacent said longitudinal axis of said body portion.

13. The tamper indicating seal of claim 1, including a pair of first score lines spaced from one another and between said at least one severable end portion and said body portion, said first segments of each of said score lines extending generally parallel to one another and said second segments of each of said score lines extending generally parallel with respect to one another.

14. The tamper indicating seal of claim 1, wherein said first score line is made within said front face to a depth so as to cause a portion of at least one of said first and second segments to be severed with respect to said body portion as said at least one end portion is folded into a generally overlying relationship with respect to said body portion.

15. The tamper indicating seal of claim 14, in which said first score line is made within said front surface to a depth which is sufficient to cause said at least one severable end portion to become severed along said first score line upon being reversely folded from said overlying relationship with respect to said body portion to a maximum angle of inclination with respect thereto of not greater than approximately 60°.

16. The tamper indicating seal of claim 15, in which each of said first and second segments extends in a straight line.

17. The tamper indicating seal of claim 16, wherein said first and second segments extend at the same oblique angle relative to said longitudinal axis.

18. The tamper indicating seal of claim 15, in which each of said first and second segments is generally arcuate.

19. The tamper indicating seal of claim 18, wherein said first and second segments extend at the same oblique angle relative to said longitudinal axis.

* * * * *